United States Patent [19]

Birtwistle et al.

[11] Patent Number: 4,989,752

[45] Date of Patent: Feb. 5, 1991

[54] FRANGIBLE ROOF JOINT FOR STORAGE TANKS

[75] Inventors: John V. Birtwistle, Chesterfield; E. Ernest Morgenegg, Jr., St. Louis; Marvin W. Ringer, Jr., Chesterfield, all of Mo.

[73] Assignee: Monsanto Company, St. Louis, Mo.

[21] Appl. No.: 16,153

[22] Filed: Feb. 18, 1987

[51] Int. Cl.[5] ..... B65D 87/00

[52] U.S. Cl. ..... 220/610; 220/89.1

[58] Field of Search ..... 220/66, 67, 89 A, 207, 220/208, 3, 54, DIG. 29, 89.1, 610

[56] References Cited

U.S. PATENT DOCUMENTS

| | | | |
|---|---|---|---|
| 1,316,968 | 9/1919 | Neill et al. | 220/81 A |
| 1,543,131 | 6/1925 | Stough | 220/5 A |
| 1,748,222 | 2/1930 | Haupt | 220/89 A |
| 1,761,697 | 6/1930 | Williams et al. . | |
| 2,135,724 | 11/1938 | McDaniel et al. | 220/5 A X |
| 2,209,399 | 7/1940 | Hall | 220/89 A X |
| 2,795,350 | 6/1957 | Lapin | 220/67 X |
| 3,111,863 | 11/1963 | Filz | 74/609 |
| 3,389,502 | 6/1968 | Leurent | 49/388 |
| 3,741,843 | 6/1973 | Louis | 156/244 |
| 4,400,918 | 8/1983 | Lewis | 52/98 |

FOREIGN PATENT DOCUMENTS

| | | |
|---|---|---|
| 14916 | 2/1977 | Japan . |
| 0000212 | 1/1979 | Japan . |
| 54212 | 1/1979 | Japan . |

*Primary Examiner*—Steven M. Pollard
*Attorney, Agent, or Firm*—W. Brooks

[57] ABSTRACT

A frangible roof joint forming a flexible gastight connection between a tank shell and a roof, comprising an annular link mechanism sealingly secured at or adjacent a first edge thereof to a rim of the tank and sealingly secured at or adjacent a second edge thereof to the periphery of the roof. The securement of the annular link mechanism to the rim and the roof is such as to permit articulation of the annular link mechanism relative to the rim and roof to a point of failure of the joint upon pressurization of the tank above a predetermined pressure.

9 Claims, 2 Drawing Sheets

FRANGIBLE ROOF JOINT FOR STORAGE TANKS

BACKGROUND OF THE INVENTION

This invention relates generally to storage tanks and, more particularly, to a frangible roof joint for such tanks, especially smaller tanks (e.g., those having a diameter of less than 50 feet (15.2m)).

In the event of a rapid pressure build-up in a storage tank, as during a fire, for example, it is important that there be emergency venting provisions to avoid rupture of the tank and spillage of its contents especially where the material being stored is flammable or combustible. One way of providing emergency venting is a frangible roof joint, which is a joint between the roof and the shell of a storage tank designed to fail at relatively low pressures. Failure of the joint provides an opening sufficiently large to vent the tank, thereby avoiding rupture of the shell itself or the floor-to-shell joint of the tank which would result in spillage.

The American Petroleum Institute (API) has developed a standard for the design and construction of welded steel storage tanks. This standard provides for the design of a frangible roof joint, but in 1978 the standard was amended to limit applicability of the frangible roof design to tanks having a diameter of fifty feet (15.2m) or more. This was done to alert the industry that frangible roof designs then available were generally not considered effective in small-diameter tanks. Moreover, the API frangible roof design standard has been further limited to tanks having a conical roof where the ratio of rise to run of the roof does not exceed two inches (51mm) in twelve (305mm). The standard is not applicable to domed roofs.

Thus there is a present need in the industry for a frangible roof design for relatively small-diameter tanks (e.g., tanks less than fifty feet (15.2m) in diameter) and for tanks having domed roofs or conical roofs where the rise of the roof exceeds the run of the roof by more than two inches (51mm) in twelve (305mm).

SUMMARY OF THE INVENTION

Among the several objects of this invention may be noted the provision of an improved frangible roof joint which has particular (albeit not exclusive) application to relatively small-diameter tanks (e.g., tanks having a diameter of fifty feet (15.2m) or less) and to tanks having domed roofs or conical roofs where the rise of the roof exceeds the run of the roof by more than two inches (51mm) in twelve (305mm); the provision of such a joint which is designed to fail at pressures substantially less than prior frangible roof joints; the provision of such a roof joint which provides a good seal between the roof and the shell of the tank: and the provision of such a roof joint which is relatively simple in construction.

Generally, this invention is directed to a frangible roof joint forming a flexible gastight connection between a tank shell and a roof. The joint comprises annular link means sealingly secured at or adjacent a first edge thereof to a rim of the tank and sealingly secured at or adjacent a second edge thereof to the periphery of the roof. The securement of said annular link means to the rim and the roof is such as to permit articulation of said annular link means relative to the rim and roof to a point of failure of the joint upon pressurization of the tank above a predetermined pressure.

Other objects and features will become in part apparent and will be in part pointed out hereinafter.

BRIEF DESCRIPTION OF THE DRAWINGS

Corresponding parts are represented by corresponding reference numerals in the several views of the drawings.

DESCRIPTION OF THE PREFERRED EMBODIMENTS

Figure 1:
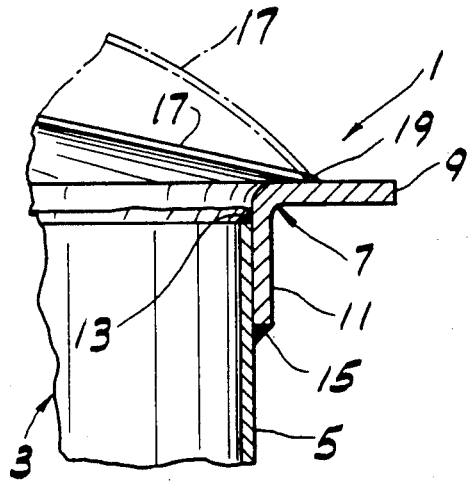
FIG. 1 PRIOR ART
FIG. 1 is a cross sectional view showing a frangible roof joint of conventional design.

Referring now to FIG. 1, there is generally indicated at 1 a conventional frangible roof joint for a storage tank 3 of relatively large diameter e.g., fifty feet (15.2m) or more). The tank 3 comprises a cylindrical shell 5 having a rim at its upper edge formed by an angle 7 affixed to the outside of the shell. The angle has a generally horizontal leg 9 extending outwardly from the shell and a vertical leg 11 welded to the shell of the tank as indicated at 13 and 15. The roof of the tank, indicated at 17, is illustrated as a conical roof sloping downwardly toward its periphery, which is welded at 19 to the horizontal leg 9 of the rim angle 7.

During a pressure rise inside the tank, the roof 17 will deflect or dish as shown in phantom in FIG. 1. This deflection is generally up and outward except at the periphery of the roof where it is generally inward because of the radial inward component of the load on the rim angle 7. The hoop compression stresses in the angle and weld area developed by this inward loading are sufficient to cause the angle to buckle inwardly before the internal tank pressure reaches a magnitude sufficient to cause tank uplift and failure of the floor-to-shell joint. During inward buckling of the rim angle 7 the weld 19 fails, resulting in separation of the roof from the shell to vent the tank.

While the design of FIG. 1 has proven generally satisfactory for large-diameter tanks with conical roofs, it is generally not considered effective for tanks of smaller diameter (e.g., less than 50 feet or 15.2 meters), since the critical inward load which must be applied to the rim angle 7 to cause it to buckle is much larger and may not be reached before the tank uplifts, causing failure at the floor-to-shell joint before failure at the roof-to-shell joint. Nor is the FIG. 1 design regarded as effective for a tank with a conical roof where the ratio of the rise to the run of the roof exceeds two inches (51mm) in twelve (305mm), or for a tank with a domed roof. In these roof configurations, the inward radial loading component is insufficient during pressurization of the tank to develop hoop compression stresses sufficient to cause inward buckling of the rim angle.

Figure 2:
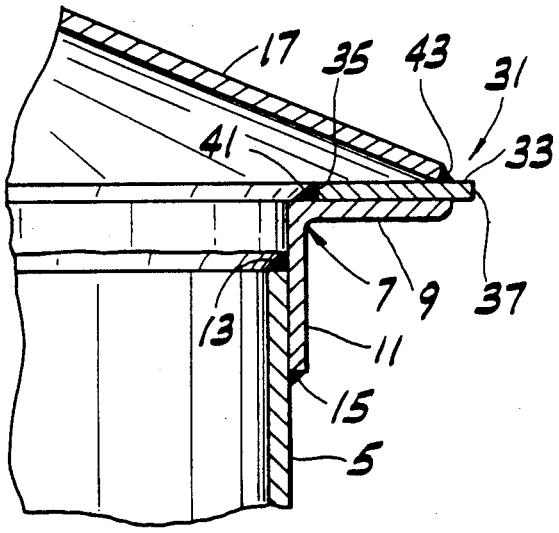
FIG. 2 is a view similar to FIG. 1 but showing a frangible roof joint of the present invention as used for a conical roof.

Referring now to FIG. 2, there is generally indicated at 31 a frangible roof joint design of the present invention, the shell, conical roof and rim angle parts being identified by the same reference numerals as in FIG. 1. As discussed, this design has particular (albeit not exclusive) application to small-diameter tanks, which may be considered to be tanks having a diameter of less than fifty feet (15.2m), regardless of the configuration of the roof.

As shown, the roof joint 31 comprises annular link means in the form of an annular plate 33 sealingly secured at or adjacent a first edge 35 thereof, constituting its inner edge, to the horizontal leg 9 of the rim angle and at or adjacent a second edge 37 thereof, constituting its outer edge, to the periphery of the roof 17, which is shown to be a conical roof. Thus, the annular plate forms a gastight connection between the roof and the rim of the tank. As will appear, the securement of the annular plate to the rim and the roof is such as to permit articulation of the annular plate relative to the rim and roof to a point of failure of the joint upon pressurization of the tank above a predetermined pressure.

Figure 2A:
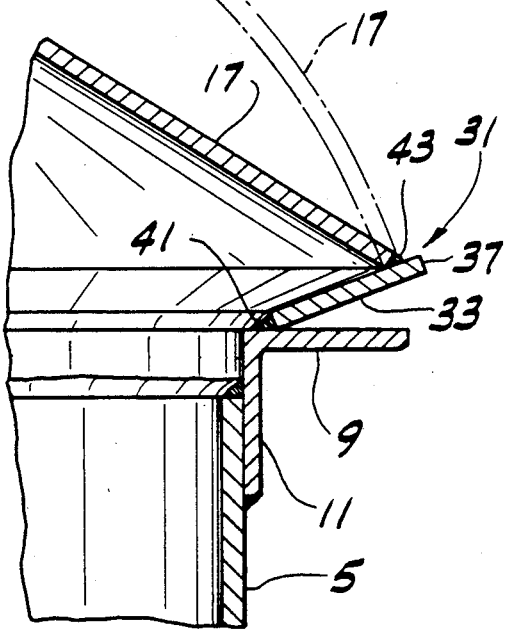
FIG. 2A is a view of the roof joint of FIG. 2 during pressurization of the tank.

More specifically, the annular plate 33 is secured to the angle 7 by a fillet weld 41 at the junction of the inner edge 35 of the plate and the top of leg 9, and to the roof 17 by a fillet weld 43 at the junction of the peripheral edge of the roof and the upper surface of the annular plate adjacent its outer edge 37. These welds 41, 43 are effective to seal the contents of the tank from the atmosphere. Upon pressurization of the tank (due to fire, explosion., etc.), these welds are stressed to the point where they permit articulation (pivoting) of the annular plate in a manner similar to a hinge or bellows. Thus, as viewed in FIG. 2A, the annular plate will pivot or rotate in the counterclockwise direction to a point where the welds 41, 43 are pryed open and tend to crack and/or where the compressive hoop stresses in the joint are such as to cause buckling failure similar to that which occurs in the conventional FIG. 1 design.

In designing the frangible joint 31, various factors must be taken into consideration. For example, the joint should be designed to fail at a pressure less than the tank uplift pressure (the pressure at which the tank will begin to lift off its foundation), although if this is not practical anchors can be provided to hold the tank on its foundation. The joint should have sufficient strength and stiffness to endure normal stresses caused by prevailing winds and to resist larger stresses created by gusting winds.

Frangible roof tanks are also vulnerable to damage if overfilled. Thus, appropriate measures wellknown to tank designers are required to insure that the liquid level in the tank does not rise above the top straight side of the tank.

By way of example, for a tank having a diameter of 20 feet (6.lm), a shell of 3/16 in. (4.8mm)thick plate, a conical roof of 5/16 in. (8.0mm)-thick plate, and a 2-½ in. (64mm) by 2-½ in. (64mm) by ¼ in. (6.4mm) rim angle, joint 31 may comprise a 2-⅜ in. (57mm)-wide annular plate 33 (as measured from inner edge 35 to outer edge 37) of ⅛ in. (3.2mm)-thick steel plate secured to the rim angle by a ⅛ in. (3.2mm) fillet weld and to the periphery of the roof by a 3/16 in. (4.8mm) fillet weld, with the distance between the welds being about 2 in. (51mm) and the annular plate projecting outwardly beyond the rim angle by about ¼ in. (6.4mm). Using an axisymmetric shell of revolution analysis program known as BOSOR 4, a tank of this construction was calculated as having an operating pressure (including the pressure required to lift the weight of the roof) of about 0.21 psig (0.014 bars), where the operating pressure is the maximum internal pressure sustainable over one-million pressure cycles without failure of the welds 41, 43. It was further calculated that the yield strength of weld 43 would be exceeded at about 0.75 psig (0.052 bars) and that the yield strength of weld 41 would be exceeded at about 1.09 psig (0.075 bars) whereupon the annular plate 33 would pivot to a point of failure of the joint, with failure occurring at about 1.5 psig (0.10 bars).

In another case, for a tank having a diameter of 18.5 ft. (5.64m), a shell of 3/16 in.(4.8mm)-thick plate, a conical roof of ½ in. (6.4mm)-thick plate, and a 2-½ in. (64mm) by 2-½ in. (64mm) by ¼ in. (6.4mm) rim angle, joint 31 may comprise a 2-⅜ in. (57mm) wide annular plate 33 (as measured from inner edge 35 to outer edge 37) of 3/16 in. (4.8mm)-thick steel plate secured to the rim angle by a 3/16 in. (4.8mm) fillet weld and to the periphery of the roof by a ¼ in. (6.4mm) fillet weld, with the distance between the welds being about 2 in. (51mm) and the annular plate projecting outwardly beyond the rim angle about ¼ in. (6.4mm). Using the aforementioned axisymmetric shell of revolution analysis program known as BOSOR 4, a tank of this construction was calculated as having an operating pressure (including the pressure required to lift the weight of the roof) of about 0.25 psig (0.017 bars), where the operating pressure is the maximum internal pressure sustainable over one-million pressure cycles without failure of the welds 41, 43. It was further calculated that the yield strength of weld 43 would be exceeded at about 1.08 psig (0.074 bars) and that the yield strength of weld 41 would be exceeded at about 1.70 psig (0.117 bars) whereupon the annular plate 33 would pivot to a point of failure of the joint, with failure occurring at about the 1.70 psig (0.117 bars).

Figure 3:
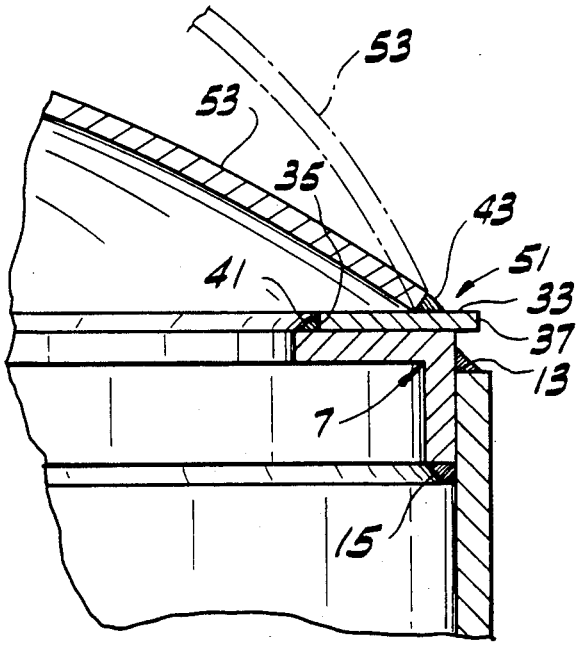
FIG. 3 is a view similar to FIG. 2 showing a frangible roof joint for a domed roof.

Indicated generally at 51 in FIG. 3 is a frangible joint similar to FIG. 2 but for a domed roof 53 rather than a conical roof. The joint is identical to joint 31 (similar parts thus being identified by the same reference numerals) except that the rim angle 7 is secured on the inside of the shell of the tank with the horizontal leg extending generally horizontally inwardly from the shell. This joint 51 functions in the same manner as joint 31 and component parts of comparable dimensions.

For example, in a tank having a diameter of 24 ft. (7.32m), a shell of ¼ in. (6.4mm)-thick plate, a domed roof of ¼ in. (6.4mm)-thick plate curved on a radius of 445.5 in. (11316mm), and a 2-½ in. (64mm) by 2-½ in. (64mm) by ¼ in. (6.4mm) rim ang1e, joint 51 may comprise a 2-½ in. (64mm)-wide annular plate 33 (as measured from inner edge 35 to outer edge 37) of ⅛ in. (3.2mm)-thick steel plate secured to the rim angle by a ⅛ in. (3.2mm) fillet weld and to the periphery of the roof by a 3/16 in. (4.8mm) fillet weld, with the distance between the welds being about 2 in. (51mm) and the annular plate projecting outwardly beyond the rim angle about ¼ in. (6.4mm). Using the aforementioned axisymmetric shell of revolution analysis program known as BOSOR 4, a tank of this construction was calculated as having an operating pressure (including the pressure required to lift the weight of the roof) of about 0.38 psig (0.026 bars), where the operating pressure is the maximum internal pressure sustainable over one-million pressure cycles without failure of the welds 41, 43. It was further calculated that the yield strength of weld 43 would be exceeded at about 1.88 psig (0.130 bars) and that the yield strength of weld 41 would be exceeded at about 1.88 psig (0.130 bars) whereupon the annular plate 33 would pivot to a point of failure of the joint, with failure occurring at about 2.51 psig (0.173 bars).

Figure 4:
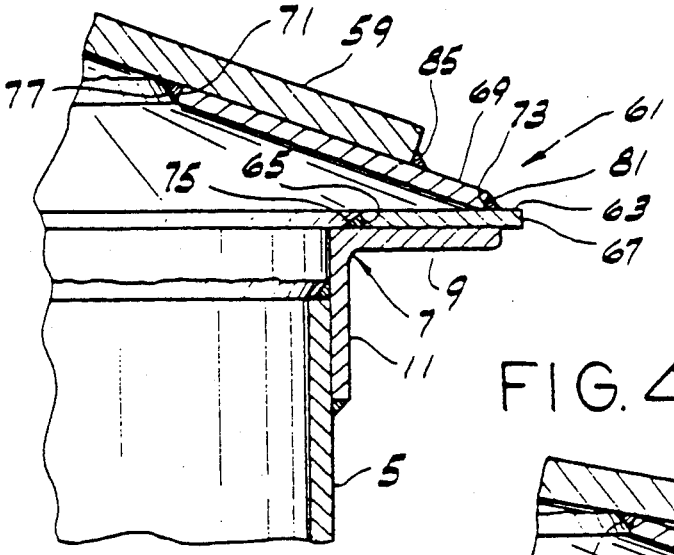
FIG. 4 is a view similar to FIG. 2 showing an alternative frangible roof joint for a conical roof.

For a conical roof 59 as shown in FIG. 4 having a thickness of ½ in. (12.7mm) or more, the roof joint generally designated 61 may be used in lieu of the FIG. 2 design. In FIG. 4, the shell and rim angle parts are identified by the same reference numerals as in FIGS. 1-3. Roof joint 61 comprises annular link means comprising a lower annular plate 63 having inner and outer edges designated 65 and 67, respectively, and an upper annular plate 69 having inner and outer edges designated 71 and 73, respectively. The lower annular plate is sealingly secured to the horizontal leg 9 of the rim angle 7 by a fillet weld 75 at the junction of the inner edge 65 of the plate and the upper surface of the leg to permit articulation of the plate and leg relative to one another, and the upper annular plate 69 is secured to the roof 59 by a fillet weld 77 at the junction of the inner edge 71 of the plate and the underside of the roof to permit articulation of the plate and roof relative to one another. The upper and lower annular plates are connected adjacent their outer edges by a fillet weld 81 to permit articulation of the annular plates relative to one another upon pressurization of the tank. Weld 81 is at the junction of the outer edge 73 of the upper annular plate and the upper surface of the lower annular plate at a location spaced inwardly from the outer edge 67 of the lower plate. Welds 75, 77 and 81 seal the contents of the tank from the atmosphere. A line of caulking indicated at 85 at the junction of the edge of the roof and the upper annular plate 69 is provided to form a non-structural moisture seal for the joint.

Figure 4A:
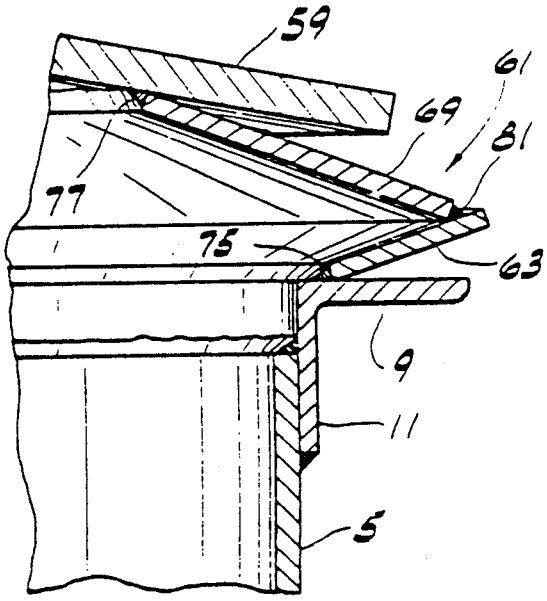
FIG. 4A is a view of the roof joint of FIG. 4 during pressurization of the tank.

Upon pressurization of the tank (due to fire, explosion, etc.), the welds 75, 77 and 81 of the frangible roof joint 61 are stressed to the point where they permit articulation (pivoting) of the upper and lower annular plates 63, 69 in a manner similar to a hinge or bellows. Thus, as viewed in FIG. 4A, the lower annular plate will pivot or rotate in the counterclockwise direction and the upper annular plate will pivot in the clockwise direction to a point where the welds are pryed open and tend to crack and/or where the compressive hoop stresses in the joint are such as to cause buckling failure similar to that which occurs in the conventional FIG. 1 design.

In designing the frangible joint 61, the same factors mentioned above must be taken into consideration, including the fact that the joint should be designed to fail at a pressure less than the tank uplift pressure (although, as mentioned, if this is not practical anchors can be provided to hold the tank on its foundation), and the joint should have sufficient strength and stiffness to endure normal stresses caused by prevailing winds and to resist larger stresses created by gusting winds. Provisions are also required to prevent the liquid level from rising above the top straight side of the tank.

Again by way of example, for a tank having a diameter of 28 (8.5m) feet, a shell of 3/16 in. (4.8mm)thick plate, a conical roof of ½ in. (17.7mm)-thick plate, and a 3 in. (76mm) by 3 in. (76mm) by ½ in. (12.7mm) rim angle, joint 61 may comprise a 2 in. (51mm)-wide lower annular plate 63 (as measured from inner edge 65 to outer edge 67 in FIG. 4) of ⅛ in. (3.2mm)-thick steel plate secured to the rim angle by a ⅛ in. (3.2mm) fillet weld and projecting outwardly beyond the rim angle ahout ¼ in. (6.4mm); and a 4 in. (102mm)-wide upper annular plate 69 (as measured from inner edge 71 to outer edge 73 in FIG. 4) of ⅛ in. (3.2mm)-thick steel plate secured to the roof by a ⅛ in. (3.2mm) fillet weld and projecting outwardly beyond the periphery of the roof about one in. (25.4mm). Using the aforementioned axisymmetric shell of revolution analysis program known as BOSOR 4, a tank of this construction was calculated as having an operating pressure (including the pressure required to raise the weight of the roof) of about 0.24 psig (0.017 bars), where the operating pressure is the maximum internal pressure sustainable over one-million pressure cycles without failure of the welds 75, 77 and 81. It was further calculated that the yield strength of the welds would be exceeded at about 0.58 psig (0.04 bars) whereupon the annular plates 63, 69 would pivot to a point of failure of the joint, with failure occurring at about 1.5 psig (0.10 bars).

Figure 5:
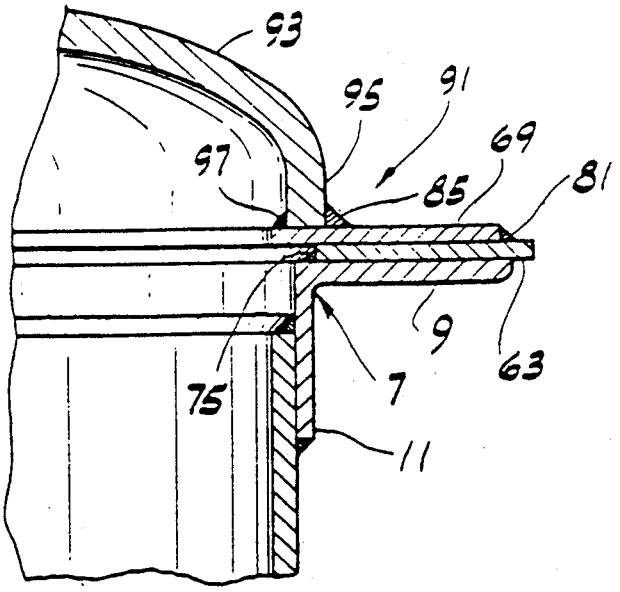
FIG. 5 is a view similar to FIG. 4 showing an alternative frangible roof design for a domed roof.

Indicated generally at 91 in FIG. 5 is a frangible joint for a domed roof 93 of relatively large thickness (e.g., greater than ½ in. (12.7mm)) having a vertical depending lip 95 at its periphery. The joint is similar to joint 61 (similar parts thus being identified by the same reference numerals) except that the upper annular plate 69 is secured to the lip 95 of the roof by a weld 97 (corresponding to weld 77 in joint 61) on the inside of the lip. Joint 91 functions in the same manner as joint 61.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A frangible roof joint for small diameter tanks wherein the joint forms a flexible gastight connection between the tank shell and the roof and comprises annular link means containing an annular plate having an inner edge corresponding to a first edge thereof and an outer edge corresponding to a second edge thereof sealingly secured at or adjacent the first edge to a rim of the tank shell, the rim of the tank shell containing an angle secured to the outside of the tank shell having a leg extending generally horizontally outwardly from the tank shell, by a first weld at the junction of the inner edge of the annular plate and the upper surface of the leg and sealingly secured at or adjacent the second edge to the periphery of the roof by a second weld at the junction of the peripheral edge of the roof and the upper surface of the annular plate adjacent the outer edge of the plate, the securement of the annular link means to the rim and the roof being such as to permit articulation of the annular link means relative to the rim and roof to a point of failure of the joint upon pressurization of the tank above a predetermined pressure.

2. A frangible roof joint as set forth in claim 1 wherein the roof is a conical roof.

3. A frangible roof joint for small diameter tanks wherein the joint forms a flexible gastight connection between the tank shell and the roof and comprises annular link means containing a lower annular plat having inner and outer edges, the inner edge corresponding to the first edge of the annular link means, and an upper annular plater having inner and outer edges, the inner edge corresponding to the second edge of the annular link means, the upper and lower annular plates being connected adjacent their outer edges to permit articulation of the annular plates relative to one another upon pressurization of the tank.

4. A frangible roof joint as set forth in claim 3 wherein the upper and lower annular plates are connected to one another by a weld.

5. A frangible roof joint as set forth in claim 4 wherein the rim comprises an angle secured to the outside of the shell of the tank having a leg extending generally horizontally outwardly from the shell, the lower annular plate being secured at its inner edge to the leg and the upper annular plate being secured at its inner edge to the roof.

6. A frangible roof joint as set forth in claim 5 wherein the roof is a conical roof and the upper annular plate is secured to the underside of the roof.

7. A frangible roof joint as set forth in claim 5 wherein the roof is a domed roof having a depending generally vertical lip at its periphery, the upper annular plate being secured to the lip by a weld on the inside of the lip at the junction of the lip and the annular plate.

8. A small diameter tank, which comprises a shell having a rim at its upper edge, a roof, and a frangible roof joint, the roof joint including annular link means sealingly secured at or adjacent a first edge thereof by a first weld to a rim of the tank shell and sealingly secured at or adjacent a second edge thereof to the periphery of the roof by a second weld, the annular link means containing a lower annular plate having inner and outer edges, the inner edge corresponding to the first edge of the annular link means, and an upper annular plate having inner and outer edges, the inner edge corresponding to the second edge of the annular link means, whereby the upper and lower annular plates are connected adjacent their outer edges to permit articulation of the annular plates relative to one another to a point of failure of the roof joint upon pressurization of the tank above a predetermined pressure.

9. A small diameter tank as set forth in claim 8 wherein the upper and lower annular plates of the annular link means are connected to one another by a weld.

* * * * *

UNITED STATES PATENT AND TRADEMARK OFFICE

CERTIFICATE OF CORRECTION

PATENT NO. : 4,989,752

DATED : February 5, 1991

INVENTOR(S) : J. V. Birtwistle et al

It is certified that error appears in the above-identified patent and that said Letters Patent is hereby corrected as shown below:

In Column 4, line 12, after the word "of" delete "1/2" and insert therefor --1/4--.

In Column 4, line 43, after the word "and" insert -- may have--.

In Column 5, line 60, delete "17.7" and insert therefor --12.7--.

In Column 5, line 68, delete "ahout" and insert therefor --about--.

In Column 6, line 62, delete "plat" and insert therefor --plate--.

In Column 6, line 65, delete "plater" and insert therefor --plate--.

Signed and Sealed this

Seventh Day of July, 1992

*Attest:*

DOUGLAS B. COMER

*Attesting Officer*

*Acting Commissioner of Patents and Trademarks*

Disclaimer and Dedication 4,989,752 — John V. Birtwistle, Chesterfield; E. Ernest Morgenegg, Jr., St. Louis; Marvin W. Ringer, Jr., Chesterfield, all of Mo. FRANGIBLE ROOF JOINT FOR STORAGE TANKS. Patent dated Feb. 5, 1991. Disclaimer and Dedication filed Jan. 10, 1997, by the assignee, Monsanto Co.

Hereby disclaims and dedicates to the Public claims 1-9 of said patent.

*(Official Gazette,* April 22, 1997)